US007156080B1

(12) United States Patent
Morris et al.

(10) Patent No.: US 7,156,080 B1
(45) Date of Patent: Jan. 2, 2007

(54) FLOW CONTROL VALVE FOR FUEL MODULE ASSEMBLY

(75) Inventors: R. David Morris, Fairfield, IL (US); Eric W. Stewart, Fairfield, IL (US)

(73) Assignee: Airtex Corporation, Fairfield, IL (US)

( * ) Notice: Subject to any disclaimer, the term of this patent is extended or adjusted under 35 U.S.C. 154(b) by 0 days.

(21) Appl. No.: 11/236,397

(22) Filed: Sep. 27, 2005

(51) Int. Cl.
*F02M 37/04* (2006.01)
*F02M 37/00* (2006.01)

(52) U.S. Cl. ..... 123/509; 123/514

(58) Field of Classification Search ..... 123/509, 123/510, 514, 198 D; 137/113, 572, 574, 137/628

See application file for complete search history.

(56) References Cited

U.S. PATENT DOCUMENTS 4,971,017 A 11/1990 Beakley et al.
4,974,570 A * 12/1990 Szwargulski et al. ..... 123/509
5,218,942 A * 6/1993 Coha et al. ..... 123/514
5,642,719 A * 7/1997 Brown ..... 123/509
5,975,061 A * 11/1999 Briggs et al. ..... 123/514
6,158,461 A * 12/2000 Frank et al. ..... 137/574
6,273,131 B1 * 8/2001 Kleppner ..... 137/565.22
6,408,830 B1 * 6/2002 McGrath ..... 123/509
6,450,151 B1 * 9/2002 Frank et al. ..... 123/514
6,474,374 B1 * 11/2002 Kleppner ..... 141/198
7,028,671 B1 * 4/2006 Mc Clure et al. ..... 123/514

* cited by examiner

*Primary Examiner*—Mahmoud Gimie
(74) *Attorney, Agent, or Firm*—Polster, Lieder, Woodruff & Lucchesi, LLC

(57) ABSTRACT

A fuel flow control valve (10) for an in-tank fuel module (M) to control fuel flow to a fuel pump (P) from either a fuel tank (T) in which the module is installed or a fuel module reservoir (V). The valve includes a disc (32) having a plurality of slots (50) formed therein through which fuel flows from an opening (O) in the module to the fuel pump. The disc is mounted on the head (40) of a valve stem (36). This allows the valve to move between one position opening a fuel flow path between the fuel tank and the fuel pump and a second position opening a fuel flow path between the fuel reservoir and the fuel pump, the valve, when opening one of the flow paths, simultaneously blocking the other flow path.

18 Claims, 5 Drawing Sheets

FLOW CONTROL VALVE FOR FUEL MODULE ASSEMBLY

CROSS REFERENCE TO RELATED APPLICATIONS

None

STATEMENT REGARDING FEDERALLY SPONSORED RESEARCH OR DEVELOPMENT

N/A

BACKGROUND OF THE INVENTION

This invention relates to in-tank fuel modules installed in automotive vehicles; and, more particularly, to a flow control valve installed in an inlet portion of a fuel module to control fuel flow to a fuel pump installed in the module from either the fuel tank in which the module is installed, or from a fuel reservoir portion of the module.

In-tank fuel modules in automotive vehicles include a fuel pump that draws fuel from the tank at a low pressure, and pumps the fuel at a higher pressure to an internal combustion engine powering the vehicle. Fuel not combusted in the engine is routed back to the module and dumped into a reservoir portion of the module. Fuel from the reservoir is then drawn into the fuel pump when, for example, the fuel level in the tank falls below that of an inlet from which fuel is drawn from the tank into the module. This occurs, for example, when the vehicle is climbing a steep hill or rounding a curve at a high rate of speed.

It is known to provide a flow control valve in an inlet or suction chamber portion of the fuel module, this chamber being located adjacent to the fuel pump inlet. In U.S. Pat. No. 4,971,017, for example, a flow control valve includes a valve member which shuttles between two positions at the pump inlet. In one position, a first opening from the tank to the pump inlet is uncovered; while in a second position, a second opening from the reservoir to the pump inlet is uncovered. In each instance, the other opening is substantially blocked so little or no fuel flows through the blocked inlet into the fuel pump inlet. In accordance with the present invention, an inlet valve is provided for improved fuel flow control from the respective openings to the pump inlet from either the tank or reservoir.

BRIEF SUMMARY OF THE INVENTION

The present invention, briefly stated, is directed to a fuel flow control or inlet valve for directing fuel flow to the inlet of a fuel pump from either a fuel tank or fuel module reservoir. The valve comprises a valve member or seal and a valve stem on which the member is mounted. The valve is installed in an inlet of a suction chamber of a fuel module through which fuel from either the tank or reservoir is drawn to the fuel pump's inlet. Normally, the suction created by the fuel pump draws the flow control valve into a position in which fuel flows from the tank to the pump inlet through openings in the valve member. At this time, flow from the reservoir to the pump inlet is blocked. However, at times when fuel cannot flow from the tank to the pump inlet, the valve moves to a position blocking the inlet into the module from the fuel tank, and unblocking the fuel flow path from the reservoir to the pump inlet.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
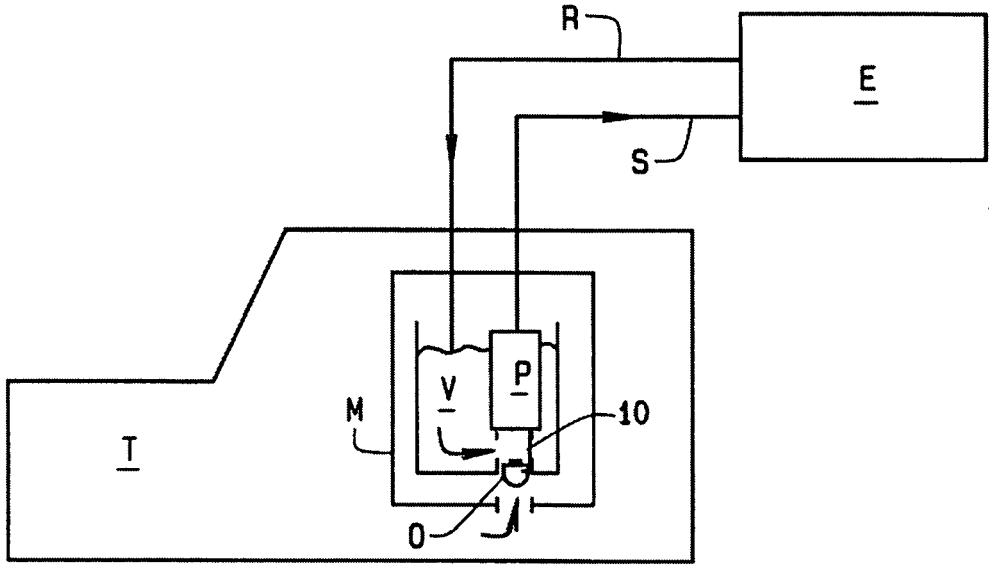
FIG. 1 is a simplified representation of a fuel system for an internal combustion engine.

Referring to FIG. 1, a fuel module assembly indicated generally M is installed in a fuel tank T of an automotive vehicle. A fuel pump P mounted in module M is supplied fuel at a low pressure either directly from tank T, or from a reservoir V of the fuel module. The fuel pump delivers high pressure fuel to a supply line S which provides the fuel to an engine E. Fuel not combusted in the engine is returned to the fuel tank by a return line R and emptied into fuel reservoir V. During normal engine operation, fuel pump P draws fuel directly from tank T, the fuel flowing from the tank to the fuel pump through an opening O in module M. There are times, however, when the opening O by which fuel flows into module M from the tank is uncovered, so no fuel can be delivered to the pump from the tank at that time. In these instances, fuel pump P draws its fuel from reservoir V. To control fuel flow to the fuel pump, a fuel flow control valve of the present invention, indicated generally 10 in the drawings, is installed in fuel module M adjacent the fuel pump inlet.

Figure 2:
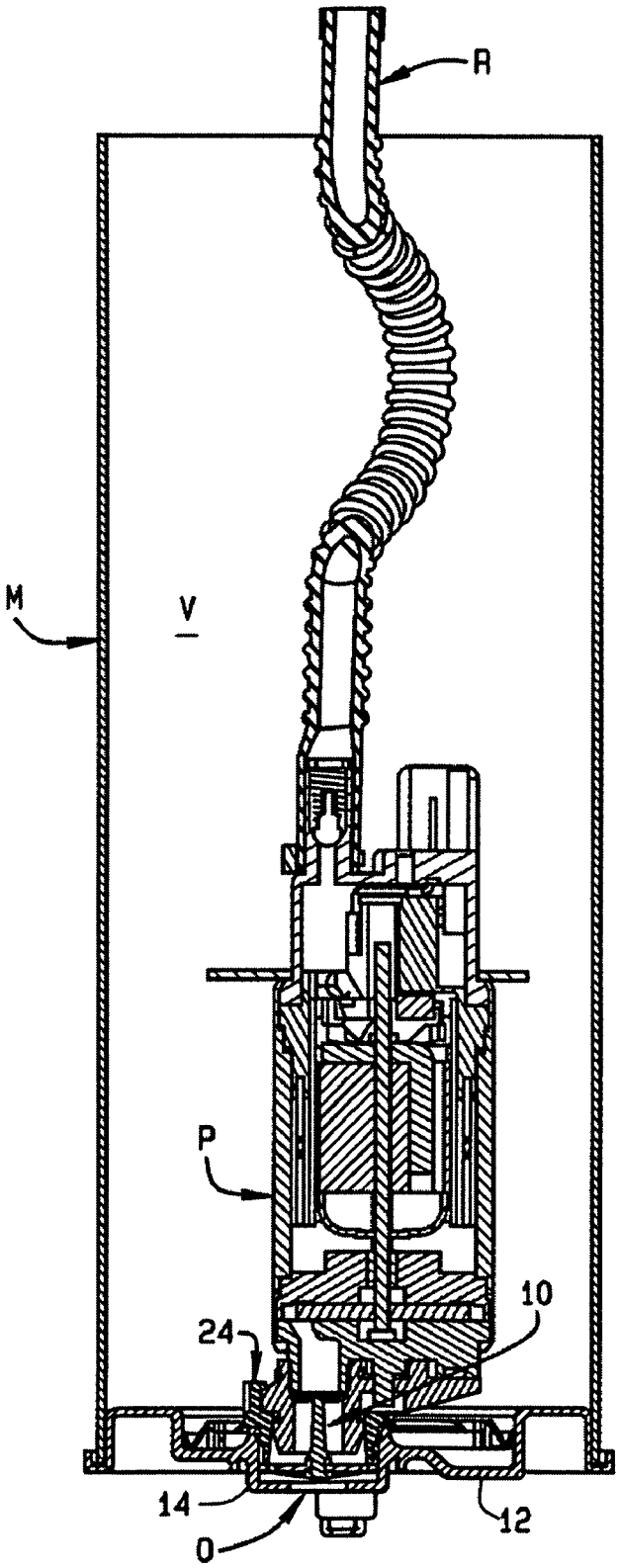
FIG. 2 is a sectional view of a fuel module assembly installed in a fuel tank.
Figure 3:
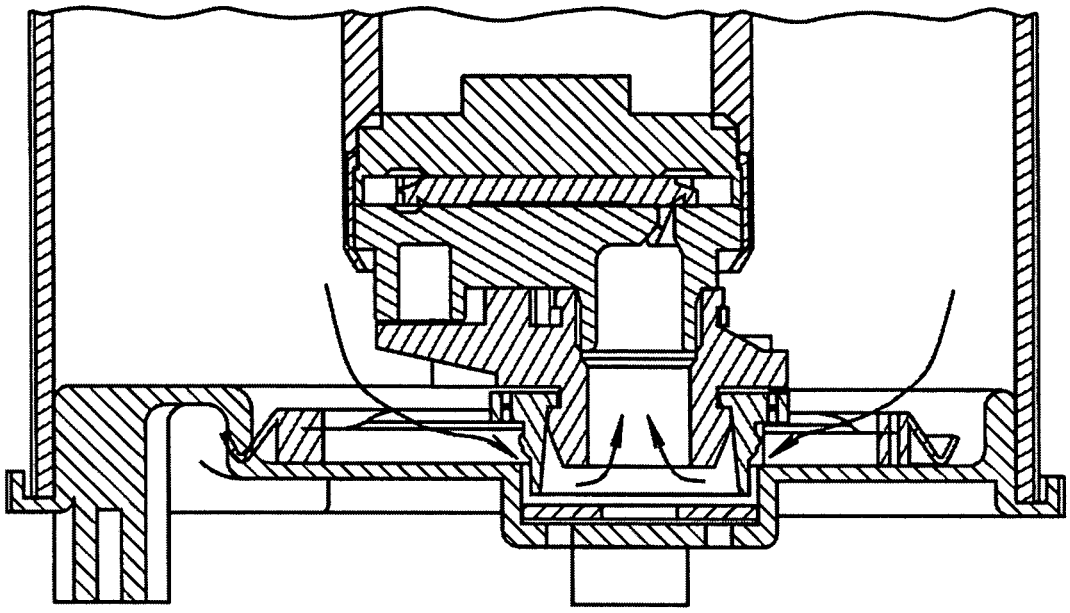
FIG. 3 PRIOR ART
FIGS. 3 and 4 are sectional views of a portion of an in-tank fuel module for an internal combustion engine illustrating a prior art flow control valve operation.
Figure 4:
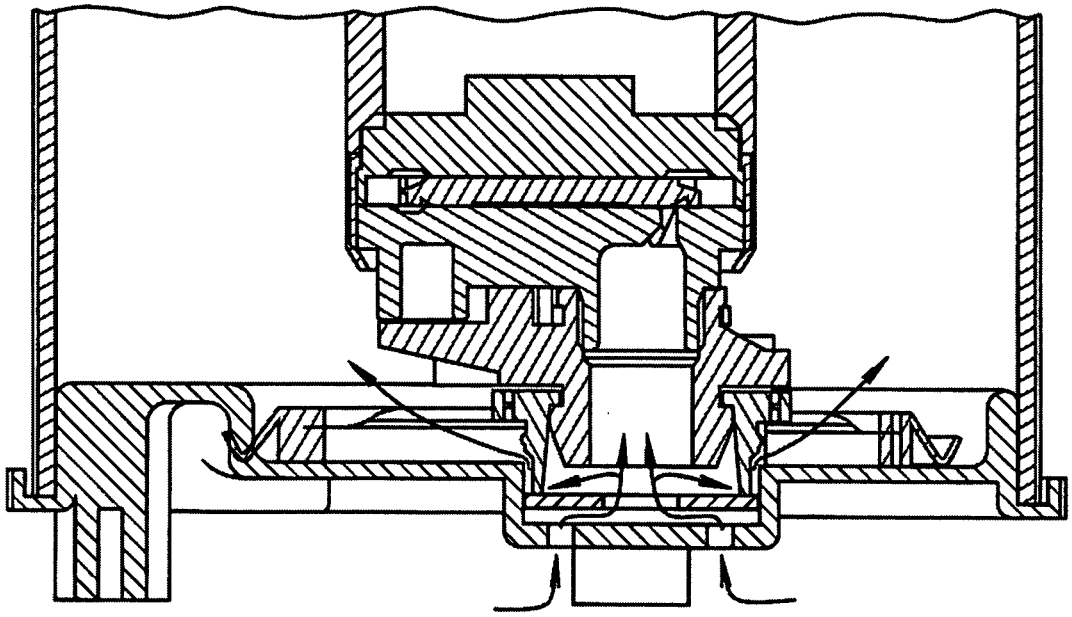
FIG. 4 PRIOR ART
Figure 5:
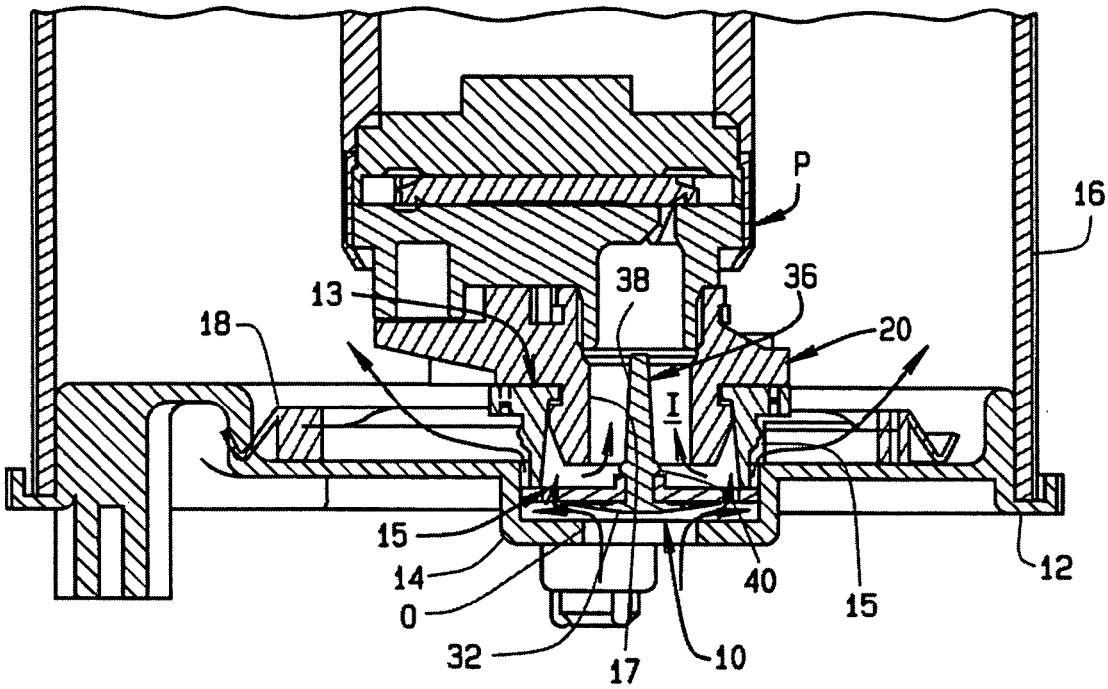
FIGS. 5 and 6 are similar sectional views of the fuel module illustrating a flow control valve of the present invention and its operation.
Figure 6:
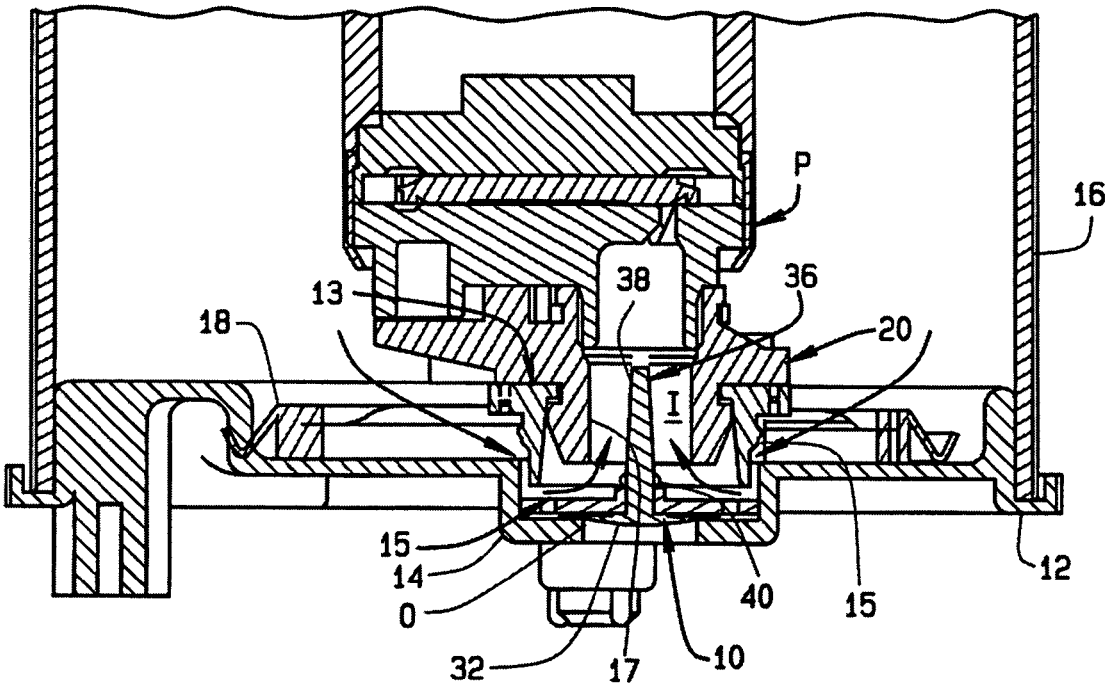
Figure 8A:
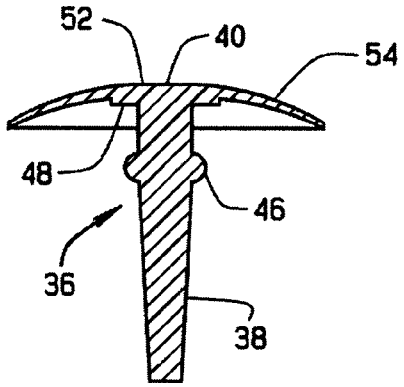
FIGS. 8A–8C are respective similar views of a stem portion of the valve; and, FIGS. 9A and 9B are respective plan and elevation views of an assembled valve.
Figure 8B:
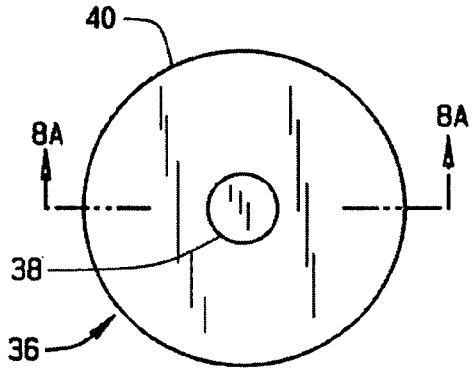
Figure 8C:
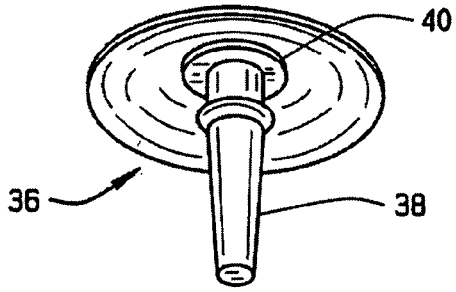

In FIG. 2, flow control valve 10 is shown installed at a fuel inlet portion I of the fuel module. This portion of the module comprises a casting 12 having a central circular section 14 in which opening O is formed, and valve 10 is mounted in this section of the module and is reciprocally movable through this section as shown in FIGS. 5 and 6. Fuel in the tank is drawn into the module through this orifice. The circumferential wall formed by central section 14 defines a portion of the fuel inlet or suction chamber I through which fuel is drawn into the fuel pump. Casting 12 attaches to an outer circumferential wall 16 of module M to define reservoir V. A fuel filter 18 seats on the upper surface of casting 12. The filter has a central opening aligning with that of opening O. A hollow, generally cylindrical collar 13 has a lower end 15 sized to fit into the opening defined by section 14 in the base of the fuel module. This lower end of the collar is spaced away from the inner surface of section 14 so there is a small, annular gap between the collar and the sidewall. Collar 13 attaches onto an isolator 20, and the inlet end of pump P is support by the isolator. The isolator protects the fuel pump from shocks and vibrations to which the fuel module is subjected. The isolator includes a bore 17 concentric with the inlet opening into the fuel pump so fuel can flow through the isolator into the fuel pump.

Figure 7A:
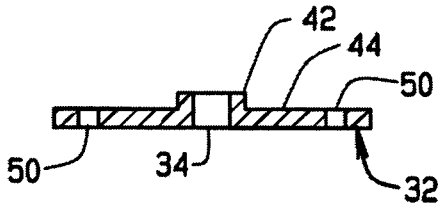
FIG. 7A is a sectional view of a disc portion of the valve, FIG. 7B a plan view of the disc, and FIG. 7C a perspective view of the disc.
Figure 7B:
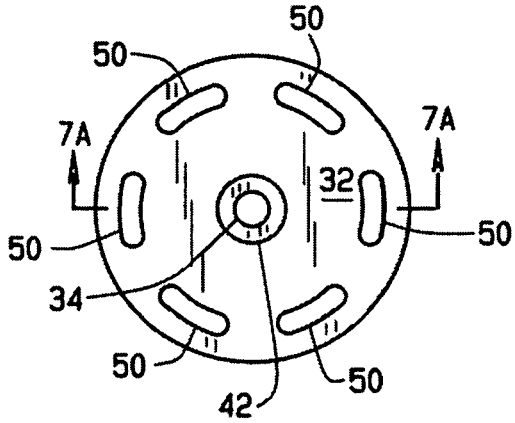
Figure 7C:
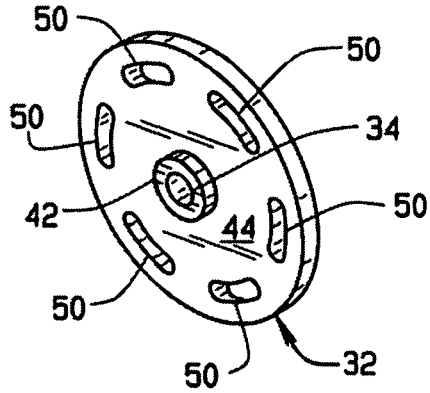

Flow control valve 10 of the present invention first comprises a two-piece valve. A first piece is a generally flat, circular disc 32 having a central opening 34. As shown in FIGS. 5 and 6, the diameter of disc 32 is slightly less than the inside diameter of section 14 and larger than the diameter of opening O. The other piece is a stem 36 having a tapered shaft 38 and a head 40 on which disc 32 is captured. Referring to FIGS. 7A–7C, an annular raised rim 42 is formed on one side 44 of disc 32. The combined height of the disc and the rim correspond to the width on stem 36 between a bead 46 formed intermediate the length of shaft 38 and an annular shoulder or boss 48 formed at the head end of the stem. When valve 10 is assembled, shaft 38 of stem 36 is inserted through opening 34 in disc 32 until the center, rim portion of the disc is captured between bead 46 and shoulder 48 of the stem.

Disc 32 has a plurality of arcuate openings or slots 50 formed, between its opening 34 and the outer edge of the disc. The position of the slots is such that they are beyond the outer margin of opening O so when fuel flow control valve 10 is in its position shown in FIG. 6, fuel cannot flow through opening O into the slots. In the drawings, disc 32 is shown to have six slots 50, corresponding ends of which are spaced 60° apart from each other. Each slot 50 subtends approximately 26° of arc meaning there is approximately 34° of arc between one end of one slot 50, and the nearest end of the adjacent slot 50. Those skilled in the art will appreciate that there could be more or fewer openings than shown in the drawings, that each opening could subtend more or less arc, and there could be more or less arc subtended between adjacent slots 50. The size and spacing of the slots 50 is a function of the fuel flow requirements for a particular engine E.

Figure 9A:
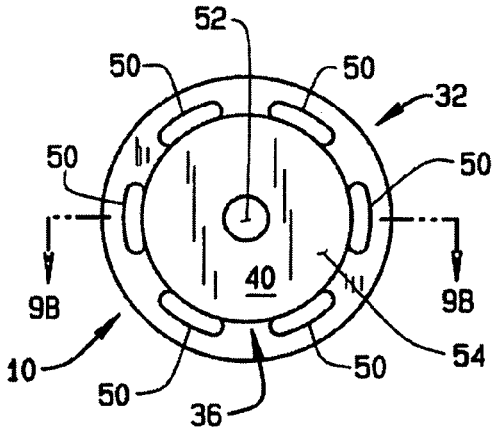
Figure 9B:
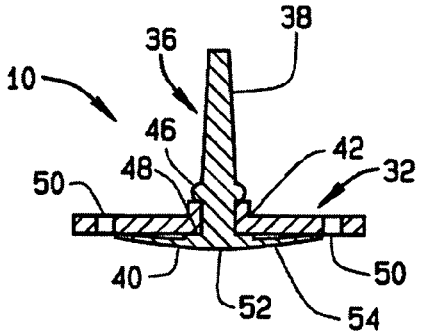

Head 40 of stem 36 comprises a circular cap having a flat top 52 and a sidewall 54 which gradually slopes from top 52 to the outer margin of the cap. The radius of cap 40 corresponds to the radius from the center of the disc to an inner reach of the slots; i.e., the inner curved edge of the slots 50. Thus, as shown in FIG. 9A, while the head of stem 36 supports disc 32, the head does not block fuel flow through the slots 50.

As shown in FIG. 5, during normal operations, fuel is drawn into module M and fuel pump P through opening O in the bottom of the fuel module. At this time, the suction exerted on valve 10 by the fuel pump draws the valve upwardly, as viewed in FIG. 5. When valve 10 is at its position shown in FIG. 6, the sloping surface of head 40, seats against opening O, blocking the opening so no fuel can flow into module M from tank T. When the valve is drawn upwardly, fuel flows through opening O and is drawn through the slots 50 in disc 32 and into the inlet portion I of the fuel pump/fuel module assembly. This is as indicated by the arrows in FIG. 5. The upward travel of valve 10 is limited by the abutment of the outer, rim portion of disc 32 against the lower end 15 of collar 13. As further indicated by the arrows, a portion of the fuel flowing through the slots 50 in disc 32 also flows around collar 13 and through filter 18 into reservoir V. The flow of fuel in this direction now prevents fuel from flowing from the reservoir to the fuel pump inlet. Accordingly, a first fuel flow path to pump P is open, while a second fuel flow path is closed.

When the vehicle is going up or down or hill, or around a corner, such that opening O is uncovered, the suction force exerted on valve 10 significantly decreases. Now, the force of fuel flowing from reservoir V toward the fuel pump, as indicated by the arrows in FIG. 6, overcomes the suction force and pushes valve 10 against opening O and valve head 40 effectively blocks the opening so fuel flow from fuel tank T into the module ceases. Further, the flow of fuel from the reservoir through the gap between collar 13 and the sidewall of section 14 is sufficiently large that enough fuel can flow to pump P that an adequate amount of fuel is supplied to engine E. Accordingly, the second fuel flow path is open while the first path is closed. However, the fuel flow from the reservoir to the fuel pump is sufficient to supply an adequate amount of fuel.

The reciprocal movement of fuel flow control valve 10 between the two positions shown in FIGS. 5 and 6 accomplishes a number of things. First, it insures that fuel is always flowing to engine E; this being from one of two sources, the fuel tank or fuel reservoir section of the fuel module. Second, when it allows fuel flow to the fuel pump through one path, it simultaneously completely blocks the other flow path. This keeps fuel flowing from one path from interfering with fuel flowing through the other path and no turbulence is created at the pump inlet which would reduce the efficient flow of fuel to engine E through the fuel pump.

Finally, it will be appreciated by those skilled in the art that the weight of two-piece valve 10 is critical. That is, it must be light enough to rise with the suction created by fuel pump P, yet sufficiently heavy to drop and seal opening O in section 14 of casting 12 when the fuel flow stream is interrupted.

In view of the above, it will be seen that the several objects and advantages of the present invention have been achieved and other advantageous results have been obtained.

Having thus described the invention, what is claimed and desired to be secured by Letters Patent is:

1. In an in-tank fuel module for an automotive vehicle, a fuel flow control valve for controlling fuel flow to a fuel pump installed in the module from either the fuel tank in which the module is installed, or a fuel reservoir portion of the module, the fuel flow control valve comprising a disc and a stem, the disc being mounted on the stem for the fuel flow control valve to move between one position opening a fuel flow path between an opening in the fuel tank by which fuel is drawn into the fuel module to the fuel pump and a second position opening a fuel flow path between the fuel reservoir and the fuel pump, the valve, when opening one of the flow paths, simultaneously blocking the other flow path.

2. The fuel flow control valve of claim 1 in which the valve is drawn by suction toward an inlet of the fuel pump to unblock the opening in the fuel module for fuel to flow to the pump from the tank, fuel also flowing from the around the disc to the fuel reservoir whereby fuel in the reservoir cannot flow to the fuel pump so the fuel flow path from the reservoir to the fuel pump is blocked.

3. The flow control valve of claim 2 in which the valve the drawn toward the opening in the fuel module when the valve is on an incline or rounding a corner and blocks the opening with fuel from the reservoir now flowing from the reservoir to the fuel pump.

4. The fuel flow control valve of claim 1 in which the valve member includes a disc having a slot therein through which fuel flows to the fuel pump from the tank through the opening in the fuel module.

5. The fuel flow control valve of claim 4 in which a plurality of slots are formed in the disc.

6. The fuel flow control valve of claim 5 in which the slots are arcuate slots.

7. The fuel flow control valve of claim 6 each which the slots all subtend the same arc, are equally spaced from a center of the disc, and adjacent slots are equally spaced from each other.

8. The fuel flow control valve of claim 1 in which the disc has a central opening for attaching the disc to the valve stem.

9. The fuel flow control valve of claim 8 in which the stem includes a tapered shaft with a head formed on one end of the shaft, the head being sized to fit in the opening in the disc to attach the disc to the stem.

10. The fuel flow control valve of claim 9 wherein the disc has circumferential rim about its central opening and the stem has a bead spaced apart from the head a distance corresponding to the thickness of the disc and its rim thereby to mount the disc on the stem between the head and bead.

11. The fuel flow control valve of claim 9 in which the disc includes a plurality of arcuate slots equidistantly spaced from the center of the disc and the head of the stem is a circular cap whose diameter corresponds to the radius from the center of the disc to an inner reach of the slots.

12. A fuel flow control valve for controlling fuel flow to a fuel pump installed in a fuel module of an automotive vehicle, the module being installed in a fuel tank of the vehicle, the module having an opening therein for fuel to flow from the tank to the fuel pump and a fuel reservoir for holding fuel returned from an engine to which fuel is supplied by the fuel pump, the valve comprising:

a disc having a plurality of slots formed therein through which fuel flows from the opening in the module to the fuel pump; and, a stem on which the disc is mounted, the disc being mounted on the stem for the fuel flow control valve to move between one position opening a fuel flow path between an opening in the fuel tank by which fuel is drawn into the fuel module to the fuel pump and a second position opening a fuel flow path between the fuel reservoir and the fuel pump, the valve, when opening one of the flow paths, simultaneously blocking the other flow path.

13. The fuel flow control valve of claim 12 in which the slots are arcuate slots.

14. The fuel flow control valve of claim 13 each which the slots all subtend the same arc, are equally spaced from a center of the disc, and adjacent slots are equally spaced from each other.

15. The fuel flow control valve of claim 12 in which the disc has a central opening for attaching the disc to the valve stem.

16. The fuel flow control valve of claim 15 in which the stem includes a tapered shaft with a head formed on one end of the shaft, the head being sized to fit in the opening in the disc to attach the disc to the stem.

17. The fuel flow control valve of claim 16 wherein the disc has circumferential rim about its central opening and the stem has a bead spaced apart from the head a distance corresponding to the thickness of the disc and its rim thereby to mount the disc on the stem between the head and bead.

18. The fuel flow control valve of claim 17 in which the disc includes a plurality of arcuate slots equidistantly spaced from the center of the disc and the head of the stem is a circular cap whose diameter corresponds to the radius from the center of the disc to an inner reach of the slots.

* * * * *